US006386841B1

(12) United States Patent
Probst

(10) Patent No.: US 6,386,841 B1
(45) **Date of Patent: *May 14, 2002**

(54) PNEUMATICALLY OPERATED HYDRAULIC PUMP

(75) Inventor: Joachim Probst, Bad Sachsa (DE)

(73) Assignee: Schmidt, Kranz & Co. GmbH, Zorge (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/473,487

(22) Filed: Dec. 28, 1999

(30) Foreign Application Priority Data

Dec. 28, 1998 (DE) ..... 198 60 466

(51) Int. Cl.[7] ..... F04B 17/00; F04B 49/00; F04B 19/14; F16D 31/02; F01L 25/02

(52) U.S. Cl. ..... 417/397; 417/307; 417/374; 417/386; 60/400; 60/401; 91/309; 91/313

(58) Field of Search ..... 91/313, 309, 306; 60/400, 401; 417/384, 386, 374, 397, 307

(56) References Cited

U.S. PATENT DOCUMENTS 263,338 A * 8/1882 Hudson et al. ..... 91/284
1,199,526 A * 9/1916 Bowser ..... 73/249
1,406,330 A * 2/1922 Barner ..... 91/306
3,618,468 A * 11/1971 Gardner et al. ..... 91/306
3,963,383 A * 6/1976 Hill ..... 417/401
4,104,008 A * 8/1978 Hoffmann et al. ..... 417/397
4,441,862 A * 4/1984 Vogel ..... 417/250
4,460,152 A * 7/1984 DiPasquale et al. ..... 251/26
4,846,045 A * 7/1989 Grach et al. ..... 91/306

FOREIGN PATENT DOCUMENTS

DE 1 230 263 12/1966
DE 26 26 954 C2 1/1978

* cited by examiner

*Primary Examiner*—Charles G. Freay
*Assistant Examiner*—Timothy P. Solak
(74) *Attorney, Agent, or Firm*—Henry M. Feiereisen

(57) ABSTRACT

A pneumatically operated hydraulic pump includes a cylinder housing accommodating a main piston to subdivide the housing interior in two working chambers. The main piston is connected to a hydraulic piston for joint reciprocation so that the hydraulic piston can carry out a suction stroke when the main piston moves to one end position and a pressure stroke when the main piston moves to the other end position. Arranged laterally to the cylinder housing is a control mechanism for regulating a flow of working fluid alternately to the working chambers. The control mechanism includes a plastic valve casing for accommodating a control piston having opposite end faces of different size to define different effective areas and thereby realize reciprocation of the control piston by the working fluid. A slide shoe is guided in the valve casing for conjoint movement with the control piston. A displacement of the main piston into the two end positions actuates respective pilot valves which regulate the reciprocation of the control piston and the slide shoe to thereby move the main piston between the end positions which discharging working fluid via the deflection zone in the slide shoe to the atmosphere.

11 Claims, 7 Drawing Sheets

PNEUMATICALLY OPERATED HYDRAULIC PUMP

CROSS-REFERENCES TO RELATED APPLICATIONS

This application claims the priority of German Patent Application Serial No. 198 60 466.1, filed Dec. 28, 1998.

BACKGROUND OF THE INVENTION

The present invention relates, in general, to pneumatically operated hydraulic pumps.

German Pat. No. DE 26 26 954 C2 describes a pneumatically operated hydraulic pump which includes a cylinder housing for accommodating a main piston which reciprocates in response to admission of air under pressure and has attached thereto a hydraulic piston connected via a suction valve with a suction conduit and via a pressure valve with a pressure conduit. Thus, the hydraulic piston alternately executes, in response to the reciprocating motion of the main piston, a suction stroke by which hydraulic medium is aspirated, and a pump stroke by which the hydraulic medium is pumped under pressure. The reciprocating movement of the main piston is realized by a partially hollow piston-type slide valve and at least one pilot valve which is actuated by the main piston and effects a movement of the slide valve from one end position into the other end position. The slide valve has opposite end faces which are different in size to thereby provide different effective areas. The smaller end face is continuously acted upon by a working fluid under pressure, such as compressed air, while the greater end face is acted upon by working fluid via the pilot valve when the slide valve is moved in the other direction. Supply of working fluid into the working chambers on either side of the main piston and discharge of outgoing air is realized by providing a complicated, stepped sleeve in which the slide valve is guided and which has formed therein transverse bores and circumferential grooves and includes several sealing rings in spaced-apart disposition. Apart from the complexity of the sleeve, a further shortcoming of this conventional hydraulic pump is the substantial wear to which the sealing rings are subject during their continuous passage of the ports of the bores in the sleeve. In addition, the sleeve must be sealingly supported in the receiving bore of the hydraulic valve casing.

SUMMARY OF THE INVENTION

It is thus an object of the present invention to provide an improved pneumatically operated hydraulic pump, obviating the afore-stated drawbacks.

In particular, it is an object of the present invention to provide an improved pneumatically operated hydraulic pump which is simple in structure and can easily be manufactured on a large scale and as a modular system.

These objects, and others which will become apparent hereinafter, are attained in accordance with the present invention by providing a cylinder housing of plastic having formed thereon a plastic valve bottom at one end and detachably connected thereto a plastic end cap at the other end thereof; a main piston subdividing the housing in two working chambers and movable between two end positions in response to admission of a working fluid, with the main piston having attached thereon a hydraulic piston, guidingly received in the end cap, for joint reciprocation with the main piston so that the hydraulic piston can carry out a suction stroke when the main piston moves to one end position, and a pressure stroke when the main piston moves to the other end position; a control mechanism for regulating a flow of working fluid alternately to the working chambers, with the control mechanism including a plastic valve casing which is mounted laterally to the valve bottom and has a chamber which contains working fluid under pressure, a control piston accommodated in the valve casing and having axial end faces which are different in size so as to define different effective areas and thereby permit reciprocation of the control piston by the working fluid, and a slide shoe guided in the chamber of the valve casing for conjoint movement with the control piston and having formed interiorly therein a deflection zone; and a valve arrangement which includes a first pilot valve disposed in a stepped bore of the valve bottom, and a second pilot valve disposed in a stepped bore of the end cap, and which is actuated by the main piston during displacement thereof into the two end positions, for regulating a flow of working fluid to the control mechanism to effect reciprocation of the control piston and the slide shoe so that the main piston moves between the end positions while working fluid is discharged via the deflection zone in the slide shoe to the atmosphere.

One aspect of the present invention is the fact that the cylinder housing with the integral valve bottom, the detachably secured end cap, the valve casing for the control piston and the slide shoe can all be made of plastic material, e.g. polyoxymethylene. Suitably, these components are manufactured as injection molded parts, thereby assuring a cost-efficient, large scale production of all sizes and types. Another aspect of the present invention is the operation of the slide shoe as a slide valve which can also be manufactured as an injection molded part of plastic material. Depending on its position in the valve casing, the slide shoe ensures a fluid communication of the working fluid into one or the other working chamber on both sides of the main piston and, as a consequence of the formed deflection zone, realizes a discharge of outgoing air from the working chambers into the atmosphere, suitably via a sound absorber.

The displacement of the slide shoe is implemented by a control piston which is accommodated in the valve casing and has opposite end faces of different sizes to thereby establish different effective areas. The smaller end face is always disposed in the chamber of the valve casing in which the slide shoe is also located and which is permanently acted upon by the working fluid. The control piston can be made from a light metal alloy and is sealingly guided in the valve casing. Unlike in conventional hydraulic pumps, the seals in accordance with the present invention do not move past ports and thus are not exposed to wear. The slide shoe is at all times constrained to move in the chamber but slides along the outer sidewall of the valve bottom. As the valve casing is flange-mounted to the side of the valve bottom, the operational position of the slide shoe is ensured. The slide shoe passes ports of a total of three channels which are positioned in sequence and extend transverse to the travel direction of the main piston. Both outer channels are directly connected to the working chambers of the cylinder housing, whereas the central channel communicates with the atmosphere, suitably via a sound absorber.

According to another feature of the present invention, the control piston has an elongate piston section which terminates in the smaller end face of the control piston and projects into the chamber of the valve casing, with the piston section having a recess which complements the length of the slide shoe and envelopes the slide shoe, thereby enhancing an interaction of the control piston with the slide shoe in a force-fitting and form-fitting manner. Suitably, the recess is made by suitably grooving the control piston.

According to another feature of the present invention, the chamber is in permanent fluid communication with the stepped bore, receiving the first pilot valve, via a branch duct. This ensures that in each position of the main piston the working fluid acts upon either the greater end face of the control piston via the first pilot valve as well as upon the channels in the valve bottom and in the valve casing, or the valve stem of the first pilot valve is pushed into the working chamber between the main piston and the valve bottom.

According to another feature of the present invention, the stepped bore in the valve bottom is connected to a space in the valve casing adjacent the greater end face of the control piston via channels in the valve bottom and in the valve casing and connected with the stepped bore, receiving the second pilot valve, in the end cap via channels in the wall of the cylinder housing and in the end cap. The greater end face is always located in a space of the valve casing, separated and sealed from the chamber. This space is acted upon by working fluid via the first pilot valve, which is disposed in the valve bottom, and relieved to the ambient atmosphere via the second pilot valve, disposed in the end cap. As the control piston and the slide shoe are not fixedly connected to one another, manufacture and assembly are further simplified.

In order to assure a discharge of air from the space, the stepped bore with the second pilot valve and the channels between the first pilot valve, space and second pilot valve, the stepped bore in the end cap is connected to the atmosphere via a transverse channel.

In a pneumatically operated hydraulic pump of the double acting type in which the main piston is connected to a second hydraulic piston in coaxial alignment with the first hydraulic piston, the incorporation of the second hydraulic piston can easily be carried out by simply providing a respective guide bore in the valve bottom. Other modifications are not necessary.

According to another concept of the present invention, the main piston may be interconnected with a bar linkage which transverses the valve bottom and is movable relative thereto and allows a manual displacement of the main piston in opposition to a force applied by a spring positioned between the main piston and the end cap. Thus, it is only necessary to incorporate the spring in the cylinder housing and to plug the connection between the chamber and the working chamber adjacent the end cap. Further modifications are not necessary. Thus, a hydraulic pump according to the present invention can be operated selectively with air or by hand.

Suitably, a hand lever is connected to the bar linkage and lockable in place during pneumatic operation of the hydraulic pump so that uncontrolled movements by the hand lever that may result in injury are prevented.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
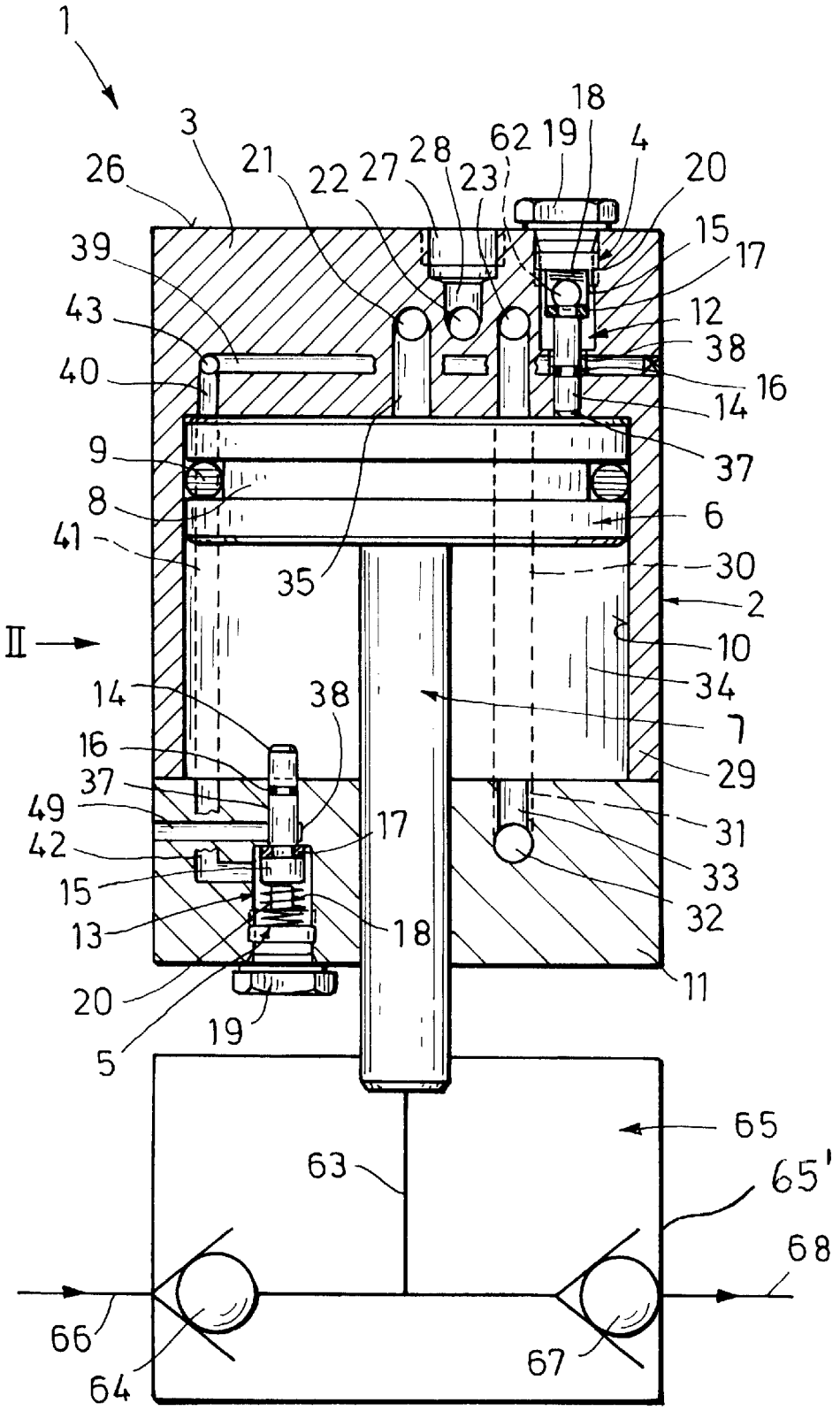
FIG. 1 is a schematic vertical longitudinal section of a single acting hydraulic pump according to the present invention in one end position.

Throughout all the Figures, same or corresponding elements are generally indicated by same reference numerals.

Turning now to the drawing, and in particular to FIG. 1, there is shown a schematic vertical longitudinal section of a single acting pneumatically operated hydraulic pump according to the present invention, generally designated by reference numeral 1. The hydraulic pump 1 includes a cylinder housing 2 which is made of plastic material, e.g. polyoxymethylene, and is formed in one piece with a valve bottom 3. Accommodated in the cylinder housing 2 is a main piston 6 which subdivides the housing 2 in two working chambers 34, 36 and has a circumferential groove 8 for receiving a sealing ring 9 which sealingly rests against an inside wall surface 10 of the housing 2. The main piston 6 reciprocates in the housing 2 between two end positions in response to admission of a working fluid, e.g. air under pressure, and actuates a pilot valve 4, when moving to the end position shown in FIG. 1, and actuates a pilot valve 5, when moving to the other end position. Each of the pilot valves 4 and 5 includes a head portion 15 and a valve stem 14 which extends from the head portion 15 and includes a central portion with a sealing ring 16 secured thereto. A further sealing ring 17 is confined between the valve stem 14 and the head portion 15.

The valve stem 14 and the head portion 15 of the pilot valve 4 are mounted in a stepped bore 12 which is formed in the valve bottom 3 and defines two bore sections 37, 38. The pilot valve 4 is loaded in the direction of the main piston 6 by a helical compression spring 18 which is disposed in a spring compartment 20 of the stepped bore 12 and rests with one end against the head portion 15 and with the other end against a confronting surface of a screw bolt 19 which can be screwed into the spring compartment 20. In like manner, the valve stem 14 and the head portion 15 of the pilot valve 5 are mounted in a stepped bore 13, which defines also two bore sections 37, 38 and is formed in an end cap 11 detachably mounted to the valve bottom distal end of the cylinder housing 2 and made of plastic material, e.g. polyoxymethylene. The pilot valve 5 is loaded by another helical compression spring 18 in the direction of the main piston 6, whereby the compression spring 18 is disposed in a spring compartment 20 and rests with one end against the head portion 15 and with the other end against a confronting surface of another screw bolt 19 which is rotated into the spring compartment 20.

The main piston 6 is connected in force fit engagement with a hydraulic pumping piston 7 which is received for sliding in the end cap 11 and projects outwardly for interaction with a valve arrangement, generally designated by reference numeral 65, and including a suction valve 64 and a pressure valve 67. The hydraulic piston 7 is slidingly received in a T-shaped conduit 63 of a high-pressure valve casing 65' and draws hydraulic fluid from a suction conduit 66 via the suction valve 64 and pumps hydraulic fluid via the pressure valve 67 through a pressure conduit 68, in response to the reciprocating motion of the main piston 6. Persons skilled in the art will appreciate that structure and operation of suction and pressure valves are generally known and thus are not described in detail here for the sake of simplicity.

Figure 2:
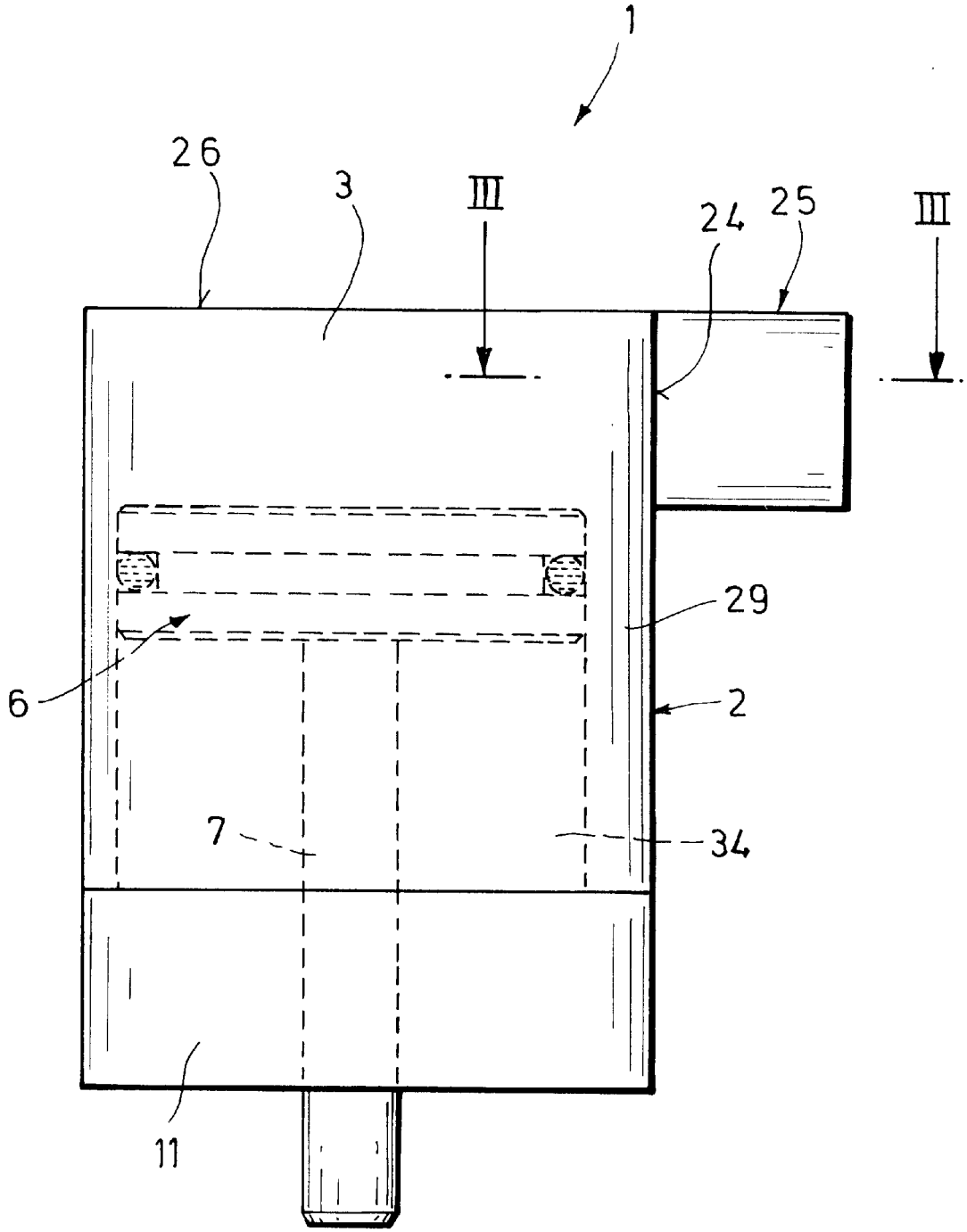
FIG. 2 is a schematic side view of the hydraulic pump in the direction of arrow II in FIG. 1.
Figure 3:
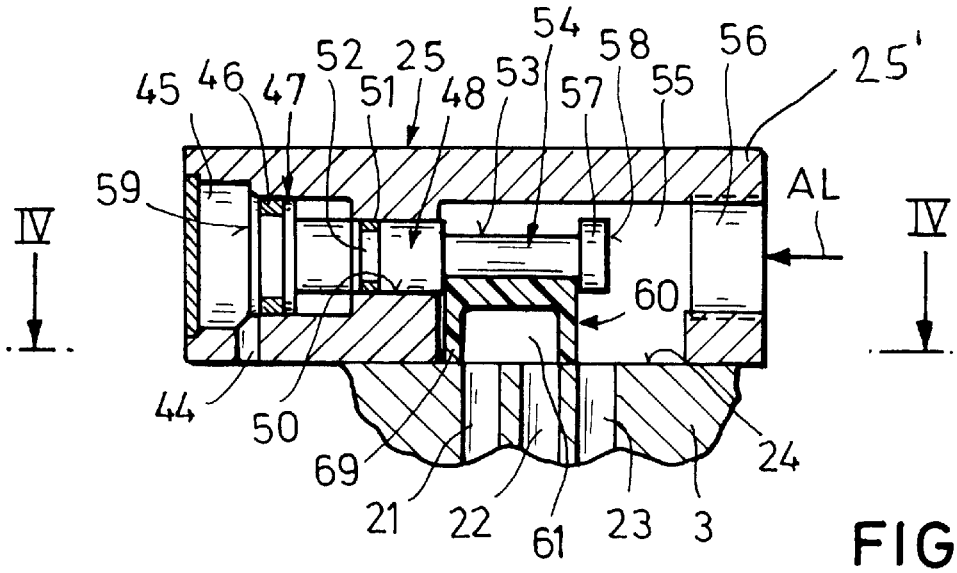
FIG. 3 is a horizontal cutaway view of the hydraulic pump, taken along the line III—III and showing in detail a control valve mechanism in one control position.

The valve bottom 3 is formed with three transverse channels 21, 22, 23 which are arranged in succession behind one another and terminate at an outer sidewall 24 of the valve bottom 3, as best seen in particular in FIG. 3. As shown in FIG. 2, a control valve assembly, generally designated by reference numeral 25 and including a valve casing 25' made of plastic material, such as polyoxymethylene, is flange-mounted laterally to the outer sidewall 24 of the valve bottom 3. The central transverse channel 22 is fluidly connected via a channel 28 to a connection port 27 which extends inwardly from an end face 26 of the valve bottom 3. Optionally, a sound absorber may be attached to the port 27. The transverse channel 23 adjoins the pilot valve 4 and is fluidly connected via a channel 72, formed in the valve bottom 3, via a longitudinal channel 30, formed in a wall 29 of the cylinder housing 2, and via channels 31, 33, formed in the end cap 11, to the working chamber 34 adjacent the end cap 11. The transverse channel 21 is fluidly connected via a channel 35 with the working chamber 36 adjacent the valve bottom 3.

Referring again to FIG. 1, it can be seen that the bore section 37 of the stepped bore 12 in the valve bottom 3 guides the valve stem 14 of the pilot valve 4 and communicates via channels 39, 40, formed in the valve bottom 3, via channel 41, formed in the wall 29 of the cylinder housing 2, and via channel 42, formed in the end cap 11, with the spring compartment 20 of the stepped bore 13 in the end cap 11. The channel 39 is further fluidly connected via a channel 43, formed in the valve bottom 3, and via a channel 44, formed in the valve casing 25', with a space 45 (FIG. 3) in the valve casing 25'. The control valve assembly 25 includes a control piston 48 which is accommodated in the valve casing 25' for reciprocation between two control positions in response to admitted working fluid and includes an end portion 47 which is received in the space 45. A sealing ring 46 is secured to the end portion 47 of the control piston 48 to seal the end portion 47 against the valve casing 25'. The bore section 38 of the stepped bore 13, located between the bore section 37 and the spring compartment 20 is connected with the ambient atmosphere A via a transverse channel 48 formed in the end cap 11.

Figure 4:
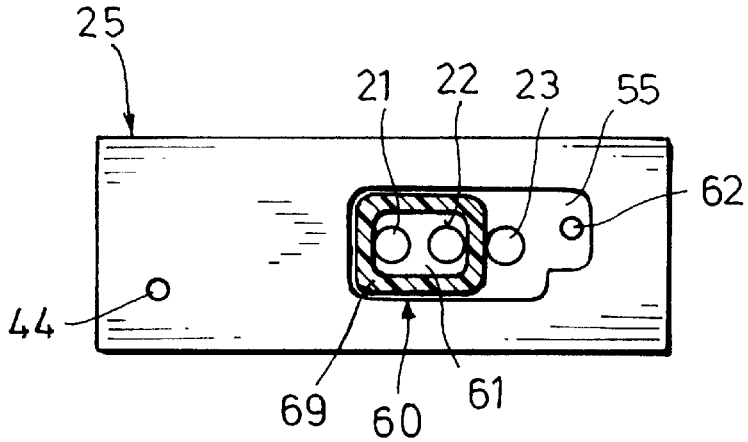
FIG. 4 is a sectional view of the control valve mechanism, taken along the line IV—IV in FIG. 3.

Turning again to FIG. 3, it can be seen that the control piston 48 is sealingly guided in the valve casing 25' in the space 45 via the sealing ring 46, on the one hand, and in a bore 50 of the valve casing 25' via a sealing ring 51 which is embedded in a circumferential groove 52 of the control piston 48. At its end distant to the sealing ring 46, the control piston 48 is provided with an elongate piston section 54 which projects into a chamber 55 of the valve casing 25' and is formed with a recess 53. The chamber 55 is in continuous communication via a port 56 with a source of working fluid AL, such as air under pressure, and, as indicated, e.g. in FIGS. 1 and 4, is in fluid communication with the spring compartment 20 of the stepped bore 12 in the valve bottom 3 via a branch duct 62. The piston section 54 terminates in an end face 57 which exhibits an effective area 58 that is smaller than an effective area 59 at the end of the piston section 47 of the control piston 48 in the space 45.

Received in the recess 53 of the piston section 54 of the control piston 48 is a slide shoe 60 which has a rectangular configuration and is made of plastic material, e.g. polyoxymethylene, with the slide shoe 60 having a length that corresponds to the length of the recess 53. The slide shoe 60 is formed interiorly with a deflection zone 61 and is capable of sliding along the outer sidewall 24 of the valve bottom 3, thereby regulating a flow of working fluid through the transverse channels 21, 22, 23.

The hydraulic pump 1 operates as follows: The chamber 55 is continuously under pressure by working fluid AL, e.g. compressed air, admitted via the port 56, thereby urging the control piston 48 to seek the control position shown in FIG. 3. As a consequence of the form-fitting and force-fitting engagement of the control piston 48 with the slide shoe 60 via the recess 53, the slide shoe 60 conjointly moves with the control piston 48 into this control position which is reached when the slide shoe 60 bears against a confronting end surface 69 of the chamber 55. In this control position, the slide shoe 60 is moved to the left, and, as shown in particular in FIG. 4, connects the transverse channels 21, 22, so that working fluid AL can flow from the chamber 55 via the channels 23, 30, 31, 32, 33 into the working chamber 34 adjacent the end cap 11, whereas the working chamber 36, adjacent the valve bottom 3 is relieved through the connection of transverse channels 21, 22 by the slide shoe 60 as the working chamber 36 is connected by the deflection zone 61 of the slide shoe 60 via the channels 35 and 28 to the atmosphere. The main piston 6 thus travels in the direction toward the valve bottom 3. Simultaneous with this displacement of the main piston 6, working fluid AL in the chamber 55 flows also via the branch duct 62 into the spring compartment 20 of the pilot valve 4 to thereby force the valve stem 14 into the working chamber 36 into a position, shown in FIG. 5.

Shortly before reaching the upper end position, shown in FIG. 1, the main piston 6 actuates the valve stem 14 of the pilot valve 4 and displaces the valve stem 14 in opposition to the spring force of the compression spring 18 until the sealing ring 17 is lifted from its seat in the stepped bore 12. This allows working fluid AL to flow via the bore section 38 of the stepped bore 12 into the channel 39 and ultimately via the channel 43 in the valve bottom 3 and the channel 44 in the valve casing 25' into the space 45 to act on the greater effective area 59 at the end of the piston section 47 of the control piston 48. At the same time, working fluid AL can also flow via the channels 40, 41, 42 into the spring compartment 20 of the pilot valve 5 so that the valve stem 14 of the pilot valve 5 is urged into the working chamber 34. This situation is illustrated in FIG. 1. The displacement of the main piston 6 into the upper end position is followed by the hydraulic piston 7 which thus executes a suction stroke by which hydraulic fluid is drawn from the suction conduit 66 through the suction valve 64.

Figure 6:
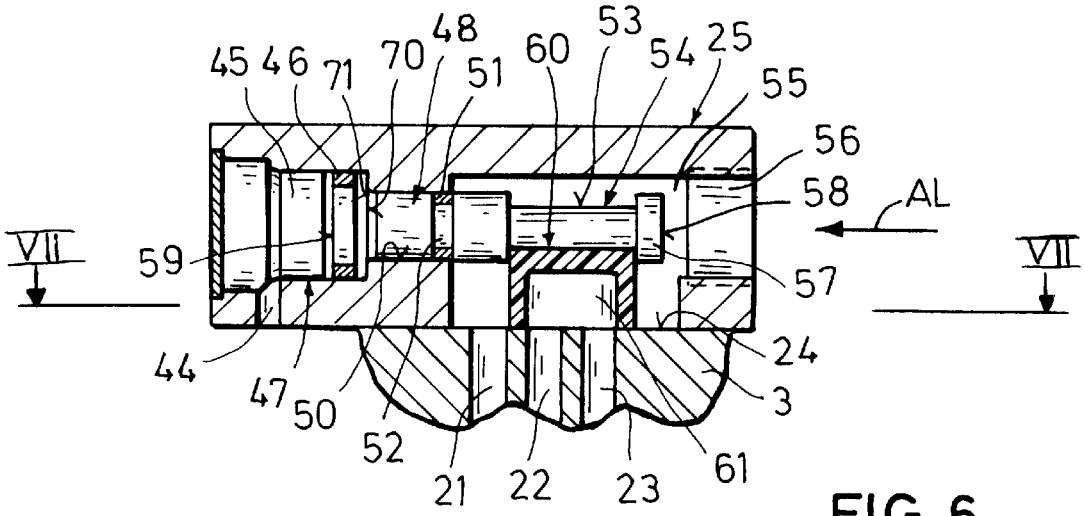
FIG. 6 is a sectional view of the control valve mechanism of FIG. 3 in another control position.
Figure 7:
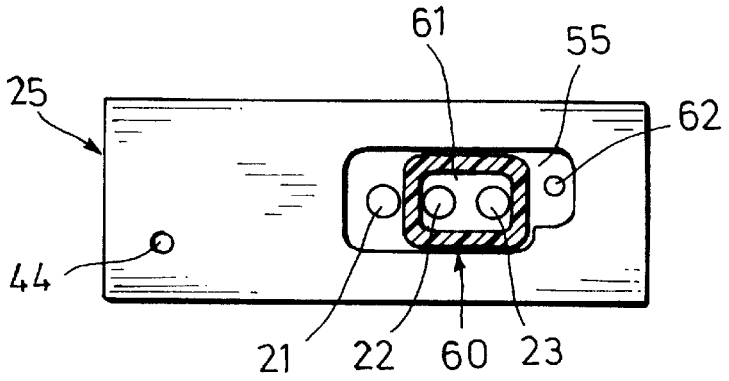
FIG. 7 is a sectional view of the control valve mechanism, taken along the line VII—VII in FIG. 6.

As the effective area 59 at the end of the piston section 47 of the control piston 48 is greater than the effective area 58 at the opposite end of the control piston 48 in the chamber 55, the control piston 48 is moved conjointly in the direction of the port 56 for the working fluid AL until a ring surface 70 of the control piston bears against a ring surface 71 of the valve casing 25', as shown in FIG. 6. The movement of the control piston 48 is accompanied by a displacement of the slide shoe 60 which thus clears the transverse channel 21 and fluidly connects the transverse channels 22, 23 (cf. FIG. 7). As a result, the connection between the port 56 and the working chamber 34 adjacent the end cap 11 is cut, and the working chamber 34 is now relieved through communication via the channels 31, 32, 33 in the end cap 11, via the channel 30 in the wall 29 of the cylinder housing 2, and via the channels 72, 23 in the valve bottom 3 with the deflection zone 61 in the slide shoe 60 and ultimately via the channels 22, 28 in the valve bottom 3 with the ambient atmosphere A.

Figure 5:
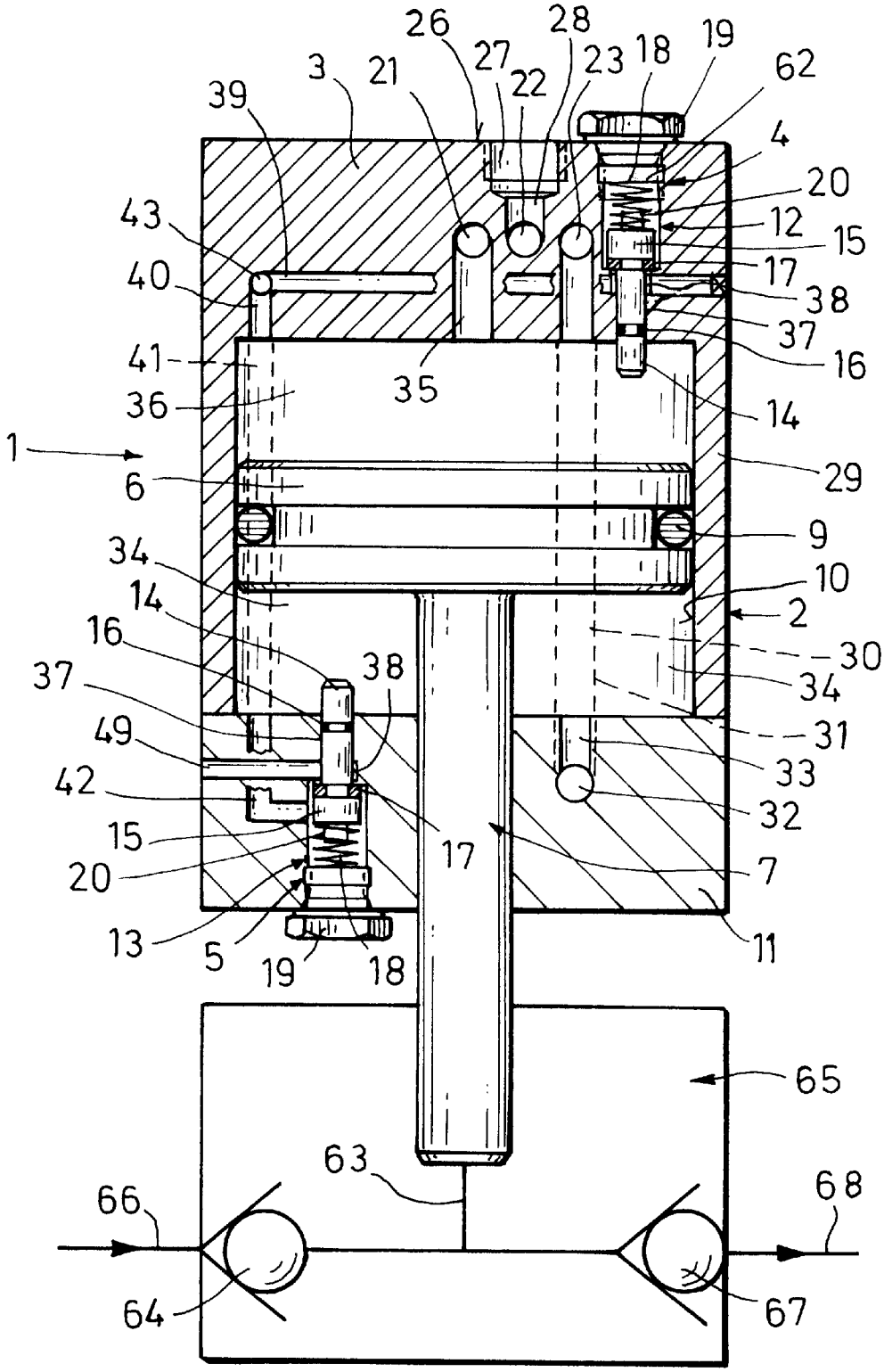
FIG. 5 is a schematic vertical longitudinal section of the single acting hydraulic pump of FIG. 1 in an intermediate position.

The working fluid AL now flows via the channels 21, 35 in the valve bottom 3 into the working chamber 36 and displaces the main piston 6 in the direction toward the end cap 11. Thus the valve stem 14 of the pilot valve 4 is released from the main piston 6 so that the compression spring 18 moves the valve stem 14 to project into the working chamber 34, thereby forcing the sealing ring 17 into its seat in the stepped bore 12. As a result, the communication between the branch duct 62 and the channel 39, which connects to the bore section 38 of the stepped bore 12 in the valve bottom 3, is cut, thereby entrapping compressed air in the channels 39, 40, 41, 42, 43, in space 45 and in spring compartment 20 of the pilot valve 5. This situation is shown in FIG. 5.

Shortly before reaching the lower end position, the main piston 6 actuates the valve stem 14 of the pilot valve 5 and displaces the valve stem 14 in opposition to the spring force of the compression spring 18 until the sealing ring 17 is lifted from its seat in the stepped bore 13. This allows a relief of the entrapped compressed air via the spring compartment 20 of the pilot valve 5 and via the bore section 38 and a transverse channel 49 into the atmosphere A. Thus, the space 45 of the control casing 25' is relieved, so that working fluid AL in the chamber 55 displaces the control piston 48 and the slide shoe 60 to the left in FIG. 6 in the direction to the space 45 to commence another cycle.

The displacement of the main piston 6 into the lower end position is followed by the hydraulic piston 7 which now executes a pump stroke by which hydraulic fluid is forced through the pressure valve 67 into the pressure conduit 68 for use in a hydraulic fluid operated system. The oscillating movement of the main piston 6 and thus of the hydraulic piston 7 results in a substantially pulsation-free flow of hydraulic fluid in the pressure conduit 68.

Figure 8:
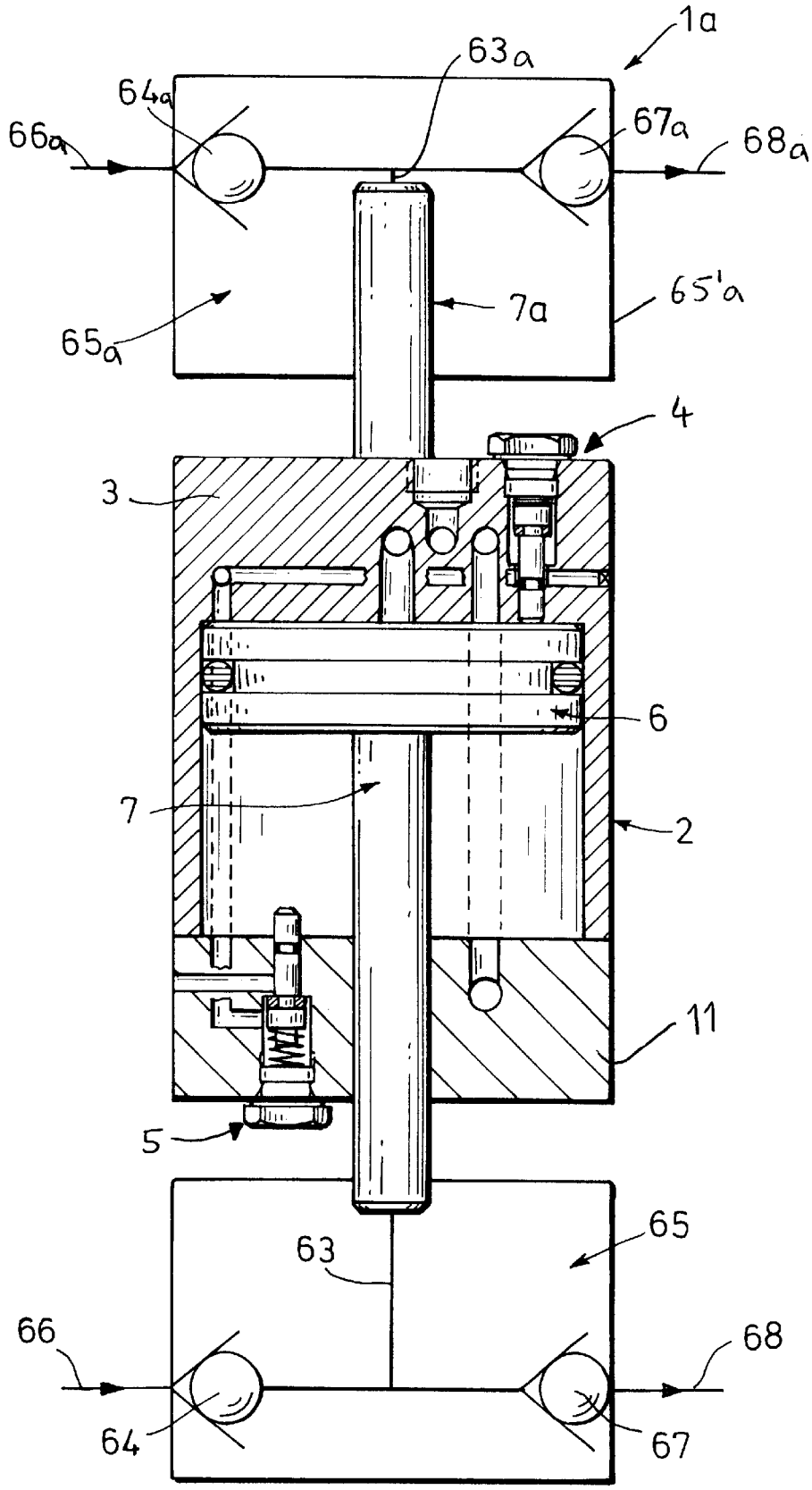
FIG. 8 is a schematic vertical longitudinal section of a double acting hydraulic pump according to the present invention in one end position.

Turning now to FIG. 8, there is shown a schematic vertical longitudinal section of a double acting hydraulic pump according to the present invention, generally designated by reference numeral 1*a*. Parts corresponding with those in FIG. 1 are denoted by identical reference numerals and not explained again. For the sake of simplicity, the hydraulic pump 1*a* will be described hereinafter only in connection with those components that are different from the embodiment of FIG. 1.

The hydraulic pump 1*a* differs from the hydraulic pump 1 only in the provision of a further hydraulic piston 7*a* to realize a double action. The hydraulic piston 7*a* is securely fixed to the main piston 6 in coaxial alignment to the hydraulic piston 7 and so extends through the valve bottom 3 as to be able to slide therein. Interacting with the hydraulic piston 7*a* is a further valve arrangement, generally designated by reference numeral 65*a* and including a suction valve 64*a* and a pressure valve 67*a*. The hydraulic piston 7 is slidingly received in a T-shaped duct 63*a* of a high-pressure valve casing 65'*a* and draws hydraulic fluid from a suction conduit 66*a* and the suction valve 64*a* and pumps hydraulic fluid via the pressure valve 67*a* through a pressure conduit 68*a*, in response to the reciprocating motion of the main piston 6.

Figure 9:
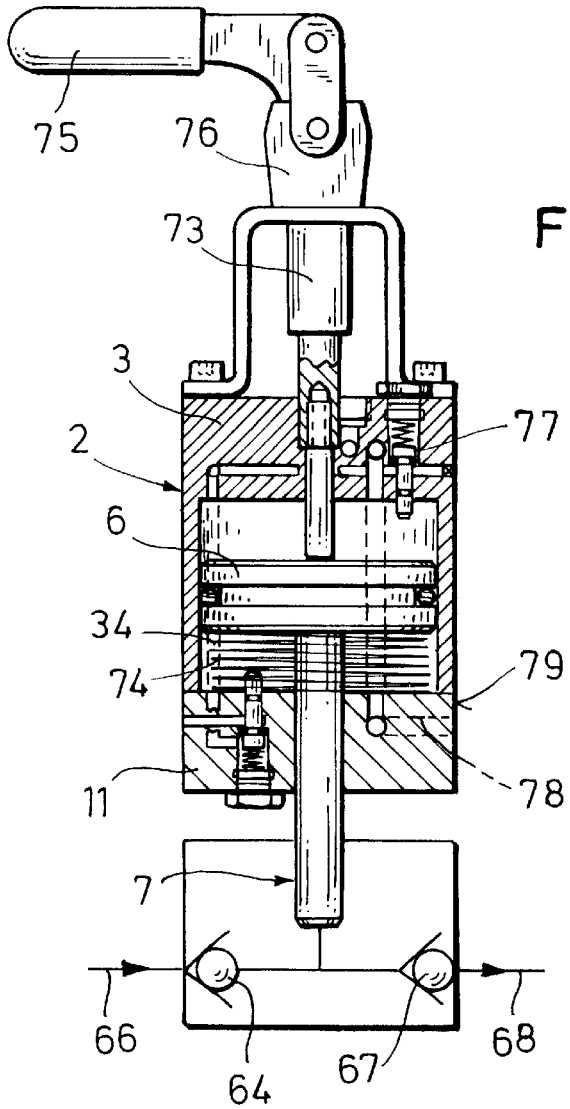
FIG. 9 is a schematic vertical longitudinal section of another embodiment of a single acting hydraulic pump according to the present invention in one operational position.

Referring now to FIG. 9, there is shown a schematic vertical longitudinal section of a variation of the single acting hydraulic pump 1, which is further equipped with a manually operated actuating mechanism. The actuating mechanism includes a bar linkage 73 which extends through the valve bottom 3 and is moveable relative thereto. The linkage 73 has one end bearing against a confronting surface of the main piston 6 and another end which is secured to a handle 75. Disposed between the linkage distal surface of the main piston 6 and the end cap 11 is a helical compression spring 74. A rotation of the handle 75 by hand about a longitudinal axis 76, defined by the hydraulic pump 1, by 180° results in a reciprocating movement of the linkage 73 commensurate with the stroke of the main piston 6 in the cylinder housing 2, so that the hydraulic piston 7 can carry out a suction stroke via suction valve 64 and a pump stroke via pressure valve 67. Channel 23 between the chamber 55 in the valve casing 25*a* and channels 30, 31, 32, 33 between the end cap 11 and the working chamber 34 are thereby closed off by a plug 77. Both actuating positions of the handle 75 and the resultant end positions of the main piston 6 are shown in FIGS. 9 and 10, respectively.

Figure 10:
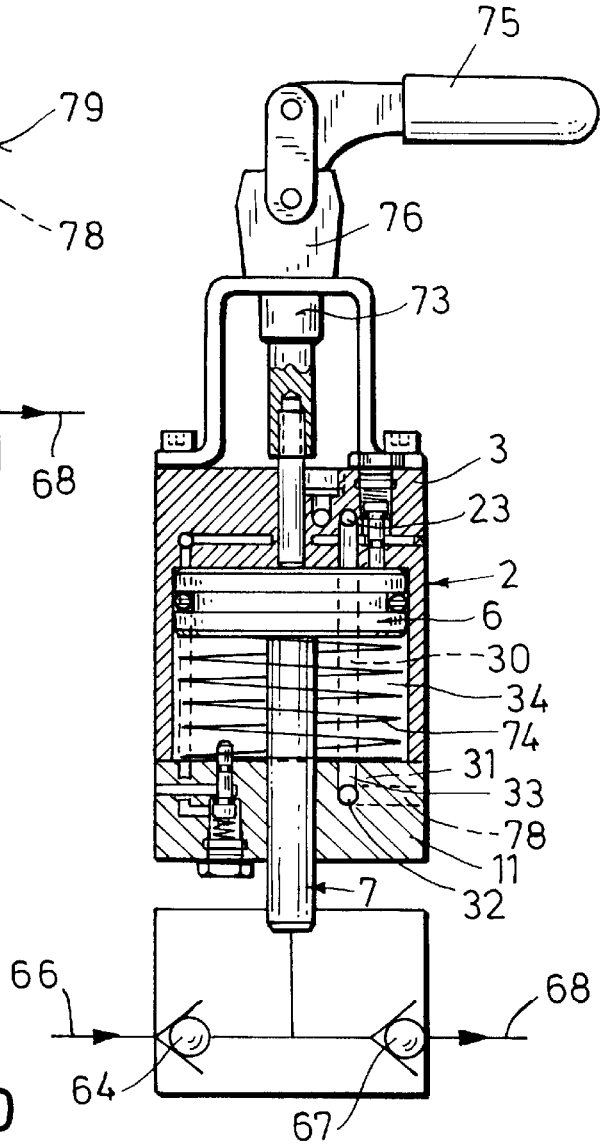
FIG. 10 is a schematic vertical longitudinal section of the hydraulic pump of FIG. 9 in another operational position.

The hydraulic pump of FIGS. 9 and 10 can also be operated pneumatically, in which case the handle 75 is locked in the position shown in FIG. 10, and thus is prevented from causing any injuries as a result of uncontrolled movement during pneumatic operation. Channels 30, 31, 32, 33 are permanently closed by the plug 77, with the suction stroke being realized by the compression spring 74. Relief of the working chamber 34 is realized via a channel 78 which has disposed therein in press-fit a filter 79 to prevent contamination of the working chamber 34.

While the invention has been illustrated and described as embodied in a pneumatically operated hydraulic pump, it is not intended to be limited to the details shown since various modifications and structural changes may be made without departing in any way from the spirit of the present invention.

What is claimed as new and desired to be protected by Letters Patent is set forth in the appended claims:

1. A pneumatically operated hydraulic pump; comprising:

a cylinder housing made of plastic material, said housing defining an interior and having opposite ends;

a valve bottom formed integrally with the housing at one end thereof;

an end cap made of plastic material detachably mounted to the housing at the other end thereof;

a main piston accommodated in the housing to subdivide the interior of the housing in two working chambers, said piston being movable between two end positions in response to admission of a working fluid and having attached thereon a first hydraulic piston, guidingly received in the end cap, for joint reciprocation with the main piston so that the hydraulic piston is destined to carry out a suction stroke when the main piston moves to one of the end positions, and a pressure stroke when the main piston moves to the other one of the end positions;

a control means for regulating a flow of working fluid alternately to the working chambers, said control means including a valve casing of plastic material which is mounted laterally to the valve bottom and has a chamber which contains working fluid under pressure, a solid control piston accommodated in the valve casing and having axial end faces which are different in size so as to define different effective areas and thereby permit reciprocation of the control piston by the working fluid, and a slide shoe guided in the chamber of the valve casing and having formed interiorly therein a deflection zone for conjoint movement with the control piston to thereby open a flow of working fluid to one of the working chambers of the main piston for movement of the main piston to one of the end positions and to open a flow of working fluid to the other one of the working chambers for movement of the main piston to the other one of the end positions; and a valve assembly, actuated by the main piston during displacement thereof into the two end positions, for regulating a flow of working fluid to the control mechanism to effect reciprocation of the control piston and the slide shoe, so that the main piston moves between the end positions while working fluid is discharged via the deflection zone in the slide shoe to the atmosphere, said valve assembly including a first pilot valve disposed in a stepped bore of the valve bottom, and a second pilot valve disposed in a stepped bore of the end cap.

2. The hydraulic pump of claim 1 wherein the flow of working fluid is realized through fluid passageways formed in the valve bottom, in a wall of the cylinder housing and in the end cap.

3. The hydraulic pump of claim 1 wherein each of the pilot valves has a sealing element for regulating a flow of working fluid.

4. The hydraulic pump of claim 1 wherein the slide shoe has a rectangular configuration, said control piston having an elongate first piston section which terminates in the effective area of relatively smaller size of the control piston and projects into the chamber of the valve casing, said first piston section having a circumferential recess which complements the rectangular configuration of the slide shoe and envelopes the slide shoe.

5. The hydraulic pump of claim 4 wherein the control piston has an elongate second piston section which terminates in the effective area of relatively greater size of the control piston, said stepped bore in the valve bottom being fluidly connected via fluid passageways in the valve bottom and the valve casing with a space in the valve casing guiding the second piston section of the control piston, and being fluidly connected via fluid passageways in the wall of the cylinder housing and the end cap with the stepped bore in the end cap.

6. The hydraulic pump of claim 1 wherein the valve bottom has a duct, said chamber of the valve casing being in permanent fluid communication with the stepped bore receiving the first pilot valve.

7. The hydraulic pump of claim 1 wherein the stepped bore in the end cap is connected to the atmosphere via a transverse channel.

8. The hydraulic pump of claim 1 wherein the main piston is in force fit engagement with a second hydraulic piston in coaxial alignment with the first hydraulic piston, said second hydraulic piston traversing the valve bottom and movable relative thereto for carrying out a suction stroke and a pressure stroke.

9. The hydraulic pump of claim 8 wherein the actuating mechanism includes a handle connected to the bar linkage, said handle being lockable in place.

10. The hydraulic pump of claim 1, and further comprising an actuating mechanism for manually moving the main piston between the end positions, said actuating mechanism including a bar linkage traversing the valve bottom and movable relative thereto and a spring positioned between the main piston and the end cap, said linkage acting on the main piston in opposition to a force applied by the spring, wherein a connection between the chamber and the working chamber positioned between the end cap and the main piston is closed off.

11. The hydraulic pump of claim 1 wherein the plastic material is polyoxymethylene.

* * * * *